US005890034A

United States Patent [19]

Nakano et al.

[11] Patent Number: 5,890,034

[45] Date of Patent: Mar. 30, 1999

[54] DEVELOPING DEVICE FOR IMAGE FORMING APPARATUS AND TONER CARTRIDGE FOR USE IN THE DEVELOPING DEVICE

[75] Inventors: Hiroshi Nakano; Kazumasa Makino, both of Nagoya, Japan

[73] Assignee: Brother Kogyo Kabushiki Kaisha, Nagoya, Japan

[21] Appl. No.: 31,181

[22] Filed: Feb. 26, 1998

[30] Foreign Application Priority Data

Feb. 28, 1997 [JP] Japan ..... 9-045902
Feb. 28, 1997 [JP] Japan ..... 9-045920

[51] Int. Cl.[6] ..... G03G 15/08

[52] U.S. Cl. ..... 399/106; 399/111; 399/262

[58] Field of Search ..... 399/102, 103, 399/105, 106, 111, 113, 252, 254, 256, 260, 262, 263; 222/DIG. 1

[56] References Cited

U.S. PATENT DOCUMENTS 5,506,665 4/1996 Ishida et al. ..... 399/119
5,771,427 6/1998 Makino ..... 399/120

*Primary Examiner*—Arthur T. Grimley
*Assistant Examiner*—Hoan Tran
*Attorney, Agent, or Firm*—Oliff & Berridge, PLC

[57] ABSTRACT

In the laser printer for performing image formation through an electrophotography process, the agitator 32 is rotated to agitate toner in the toner cartridge 30 to supply toner through the toner exhaust port 206 to the process unit 7. To rotate the agitator 32, the engagement member 302 and the flange 304 are inserted in the end port 230 of the toner cartridge 30. The sealing member 306 is attached in close contact with the engagement member 302 and the flange 304. The washer member 308 is disposed between the sealing member 306 and the flange 304. The grooved portion 305 is provided on the contact surface of the flange 304 in contact with the washer member 308.

20 Claims, 17 Drawing Sheets

302
304
32
312
300
400
406a
406b
408a
408b
410
318
310

FIG.9
FIG.9(a)
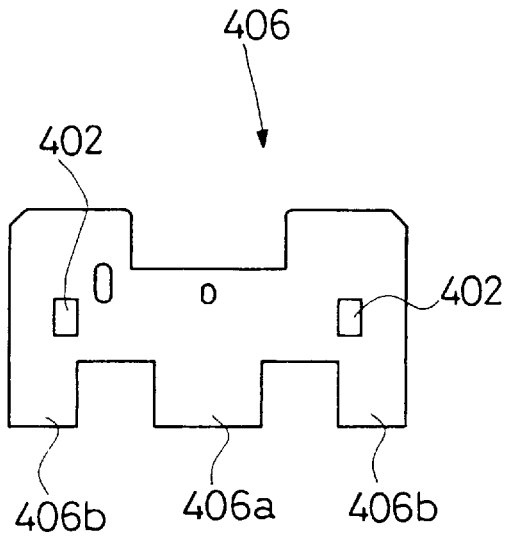
FIG.9(b)
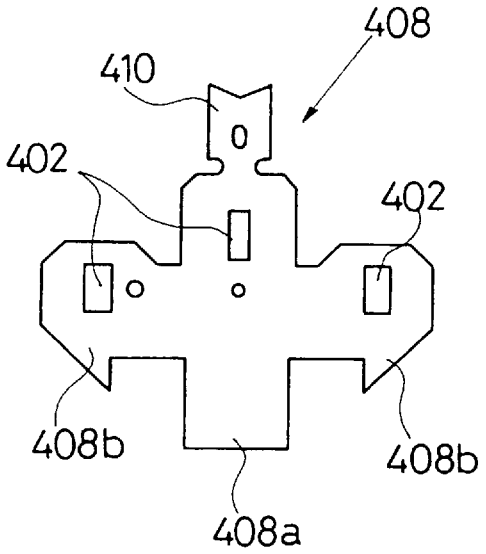

DEVELOPING DEVICE FOR IMAGE FORMING APPARATUS AND TONER CARTRIDGE FOR USE IN THE DEVELOPING DEVICE

BACKGROUND OF THE INVENTION

1. Field of the Invention

The present invention relates to a toner cartridge for use in a developing device and the developing device for an image forming apparatus for performing an image formation by an electrophotography process using toner that is supplied through a toner supply port from a toner cartridge by rotation of an agitator attached to a rotating shaft provided in the toner cartridge. In particular, the invention relates to a developing device for an image forming apparatus capable of preventing leakage of toner from a toner cartridge.

2. Description of Related Art

Heretofore, there have been proposed various types of developing devices for an image forming apparatus, e.g., a laser printer and the like. Many of the developing devices are constituted as a unit capable of being detachably mounted on a laser printer and also are provided with an exchangeable toner cartridge serving as a toner storing portion.

An embodied example of such the developing device is described referring to FIG. 17. FIG. 17 is an explanatory view of schematically showing a main part of the conventional developing device.

In FIG. 17, the developing device has a toner cartridge 100 which accommodates therein toner. The toner cartridge 100 is provided with a toner exhaust port 101 and an agitator 103 for agitating toner. In a frame F of a process unit supporting the toner cartridge 100, a toner introduction port F0 is formed corresponding to the toner exhaust port 101 of the toner cartridge 100. The frame F includes an upper frame F1 and a lower frame F2 which form a closed developing chamber 102. In the developing chamber 102, a toner supply roller 104 is rotatably disposed and a developing roller 105 is arranged adjacent to the supply roller 104. Thus, toner is supplied due to rotation of the agitator 103 from the atoner cartridge 100 through the toner exhaust port 101 and the toner introduction port F0 into the developing chamber 102. Rotation of the toner supply roller 104 then causes supply of the toner onto the developing roller 105.

A blade 107 is secured on an inner wall of the upper frame F1, above the developing roller 105, by a fixing member 106. This blade 107 serves to regulate the thickness of a toner layer formed on a circumferential outer surface of the developing roller 105. The developing roller 105 is disposed so as to be in contact with a photosensitive drum 108. An electrostatic latent image can be formed on a circumferential outer surface of the photosensitive drum 108 by a light exposure unit (not shown) which scans the surface of the drum 108 with laser light in accordance with image data. The developing roller 105 then performs toner development by supplying toner on the electrostatic latent image formed on the surface of the photosensitive drum 108. The developed image is transferred onto a paper sheet fed from a paper supply unit (not shown) to form the visual image thereon.

In the toner cartridge 100 of the conventional developing device, rotation of the agitator 103 in the toner cartridge 100 is caused by the driving power of motors disposed outside the toner cartridge 100. Therefore, a power transmitting member for causing rotation of the agitator is inserted in a port formed in the toner cartridge 100. A sponge member is firmly attached to the power transmitting member so as to be compressed toward the port by a pressing member of the power transmitting member, thereby closing the port.

When a rotation speed of the agitator 103 becomes higher, the sponge member tends to rotate along with the agitator owing to a large frictional power generated between the sponge member and the pressing member of the power transmitting member, which may cause leakage of toner through gaps between the sponge member and the port of the toner cartridge 100 to the outside. The leaked toner may stick to other portions in the image forming apparatus, for example, the outer surface of the toner cartridge 100, which may make operator's hands dirty in an exchanging operation of the toner cartridge 100. The leakage of toner is desired to be perfectly prevented from occurring.

To prevent the rotation of the sponge member, it is conceivable that, for example, a double-sided adhesive tape is provided on the sponge member whereby the sponge member is secured on the inner surface of the toner cartridge 100. At the time of assembling of the agitator 103 in the toner cartridge 100, however, a removing operation to remove releasable paper from the double-sided adhesive tape is troublesome and the adhesive surface of the tape may stick to unwanted portions except a predetermined portion in the toner cartridge 100, causing a long time for assembling them. Additionally, toner leakage may caused if the sponge member is adhered through the double-sided adhesive tape to a position displaced from a predetermined position in the toner cartridge 100.

SUMMARY OF THE INVENTION

The present invention has been made in view of the above circumstances and has an object to overcome the above problems and to provide a developing device for an image forming apparatus, capable of preventing rotation of a soft sealing member provided in a toner cartridge to surely prevent the leakage of toner therefrom, and a toner cartridge for use with the developing device.

Another object of the present invention is to provide a developing device for an image forming apparatus and a toner cartridge for use in the developing device capable of assembling an agitator in the toner cartridge without troublesomeness.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a toner cartridge for use in a developing device for an image forming apparatus of the present invention for performing image formation by an electrophotography process comprises a cartridge body for accommodating toner therein, which is provided with a supply port through which the toner is supplied to a developing portion and an end port at an end thereof, an agitating member disposed rotatably in the cartridge body, for agitating the toner by rotation in the cartridge body and for supplying the toner through the supply port to the developing portion, a power transmitting member provided at an end of the agitating member and inserted in the end port of the cartridge body, for transmitting a driving power from an outside member to the agitating member to agitate the agitating member, a soft sealing member disposed between an inner wall of the end port of the cartridge body and the power transmitting member, and a grooved portion provided on at least one of contact surfaces of the soft sealing member and the power transmitting member, where the both members come into contact with each other.

In the above toner cartridge, the grooved portion is formed on at least one of contact surfaces of the soft sealing member and the power transmitting member, so that the contact area between the contact surface of the soft sealing member and that of the power transmitting member is decreased and thus the contact resistance is reduced. As a result, even when the power transmitting member is rotated to cause the rotation of the agitator, the soft sealing member does not rotate with respect to the cartridge body, thus preventing leakage of toner from the cartridge body.

There is a possibility that the toner entering between the contact surface of the soft sealing member and that of the power transmitting member causes a large friction resistance between those contact surfaces. However, in the above device according to the present invention, toner will enter in the grooved portion and not exist between those contact surfaces, which makes it possible to prevent the increase in friction resistance. Preferably, the power transmitting member for rotating the agitator comprises a pressing member such as a flange for pressing the soft sealing member toward the end port of the toner cartridge.

Here, the image forming apparatus for forming an image by an electrophotography process means that an image forming apparatus, e.g., a laser printer, etc., which forms an image by supplying toner onto an electrostatic latent image formed on an outer surface of a photosensitive drum and the like to develop the electrostatic latent image and then transferring the developed image onto paper.

According to another aspect of the invention, there is provided a developing device for an image forming apparatus for performing image formation by an electrophotography process, the developing device comprising a cartridge body for accommodating toner therein, which is provided with a supply port through which the toner is supplied to a developing portion and an end port at an end thereof, an agitating member disposed rotatably in the cartridge body, for agitating the toner by rotation in the cartridge body and for supplying the toner through the supply port to the developing portion, a power transmitting member provided at an end of the agitating member and inserted in the end port of the cartridge body, for transmitting a driving power from an outside member to the agitating member to agitate the agitating member, a soft sealing member disposed between an inner wall of the end port of the cartridge body and the power transmitting member, and a grooved portion provided on at least one of contact surfaces of the soft sealing member and the power transmitting member, where the both members come into contact with each other.

According to another aspect of the invention, there is provided a toner cartridge for use in a developing device for an image forming apparatus for performing image formation by an electrophotography process, the toner cartridge comprising a cartridge body for accommodating toner therein, which is provided with a supply port through which the toner is supplied to a developing portion and an end port at an end thereof, an agitating member disposed rotatably in the cartridge body, for agitating the toner by rotation in the cartridge body and for supplying the toner through the supply port to the developing portion, a power transmitting member provided at an end of the agitating member and inserted in the end port of the cartridge body, for transmitting a driving power from an outside member to the agitating member to agitate the agitating member, a soft sealing member disposed between an inner wall of the end port of the cartridge body and the power transmitting member, and a sucker member having a sucking effect with respect to an inner wall of the end port of the cartridge body, which is disposed on a plane of the soft sealing member which comes into contact with the inner wall of the end port.

In the above toner cartridge, the sucker member does not immediately adhere to the inner surface of the cartridge body or the soft sealing member even if touching them when the power transmitting member is inserted in the port of the cartridge body with the sealing member put therebetween. The sucker member compressed comes to attach in close contact with the contact surface after a lapse of time. As a result, the sealing member can be prevented from rotating during rotation of the power transmitting member for rotating the agitator, achieving the prevention of toner leakage. The member having a suction property does not adhere to unwanted portions in the toner cartridge, which does not cause any trouble in an assembling operation.

According to another aspect of the present invention, there is provided a developing device for an image forming apparatus for performing image formation by an electrophotography process, the developing device comprising a cartridge body for accommodating toner therein, which is provided with a supply port through which the toner is supplied to a developing portion and an end port at an end thereof, an agitating member disposed rotatably in the cartridge body, for agitating the toner by rotation in the cartridge body and for supplying the toner through the supply port to the developing portion, a power transmitting member provided at an end of the agitating member and inserted in the end port of the cartridge body, for transmitting a driving power from an outside member to the agitating member to agitate the agitating member, a soft sealing member disposed between an inner wall of the end port of the cartridge body and the power transmitting member, and a sucker member having a sucking effect with respect to an inner wall of the end port of the cartridge body, which is disposed on a plane of the soft sealing member which comes into contact with the inner wall of the end port.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 8(*b*) is a front view of the agitator;

FIG. 8(*c*) is a bottom view of the agitator;

FIG. 8(*d*) is a view showing the agitator rotated downward about an axis thereof from a position shown in FIG. 8(*a*);

FIG. 9(*a*) is a front view of a first blade in the present embodiment;

FIG. 9(*b*) is a front view of a second blade in the present embodiment;

FIG. 10(*b*) is a partially enlarged sectional view of the flange of FIG. 10(*a*);

FIG. 10(*c*) is a side view of the engagement member and the flange, which is seen from a direction A in FIG. 10(*a*);

FIG. 11(*b*) is an assembled sectional view of the engagement portion and the flange assembled in the end port of the toner cartridge;

FIG. 16(*b*) is a graph of detecting the amount of residual toner in the toner cartridge using another agitator with two blades.

DETAILED DESCRIPTION OF THE PREFERRED EMBODIMENTS

A detailed description of a preferred embodiment of a laser printer embodying a developing device for an image forming apparatus, a toner cartridge used in the developing device, and the image forming apparatus according to the present invention will now be given referring to the accompanying drawings.

Figure 1:
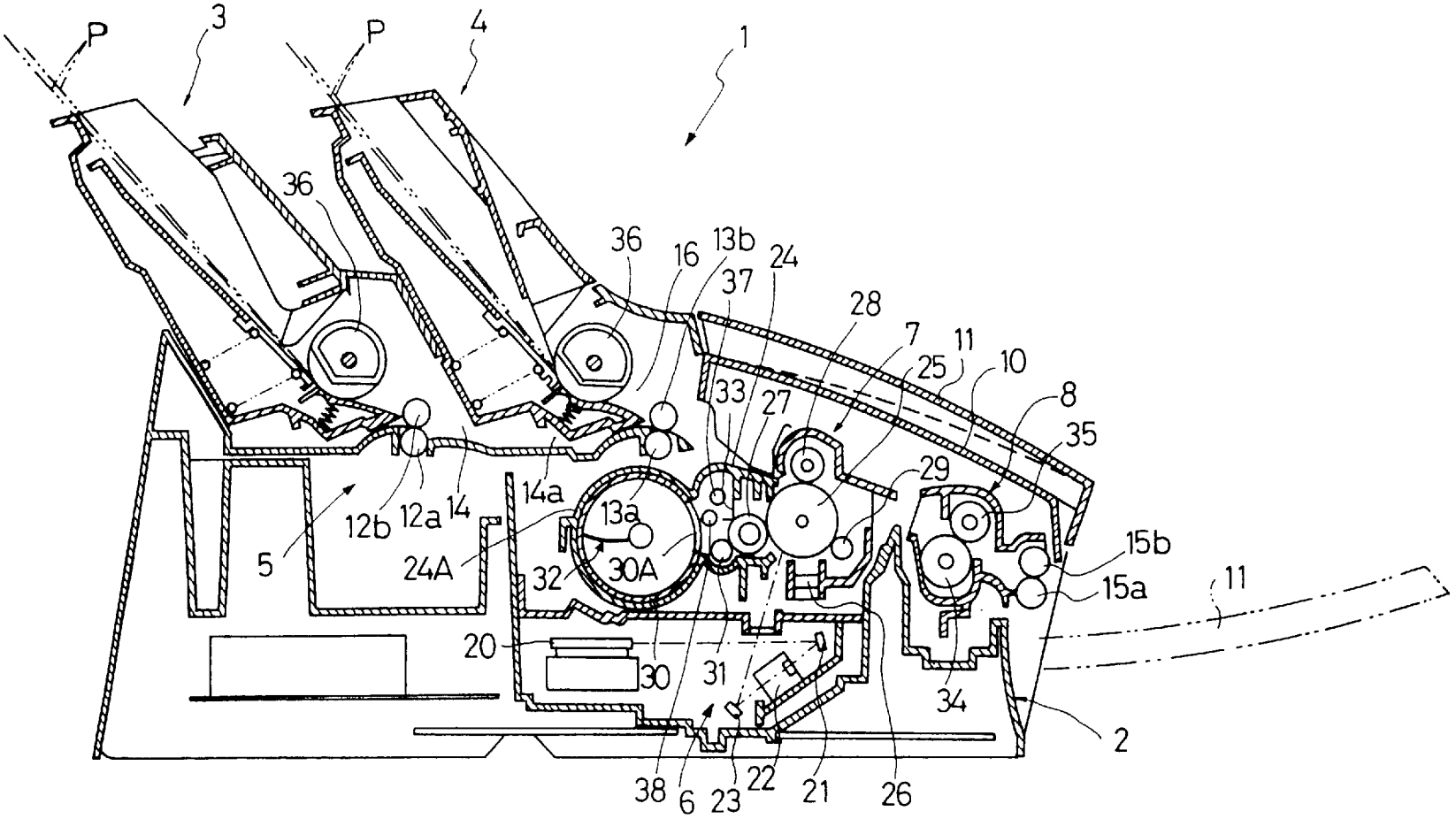
FIG. 1 is a sectional side view of a laser printer in an embodiment according to the present invention.
Figure 2:
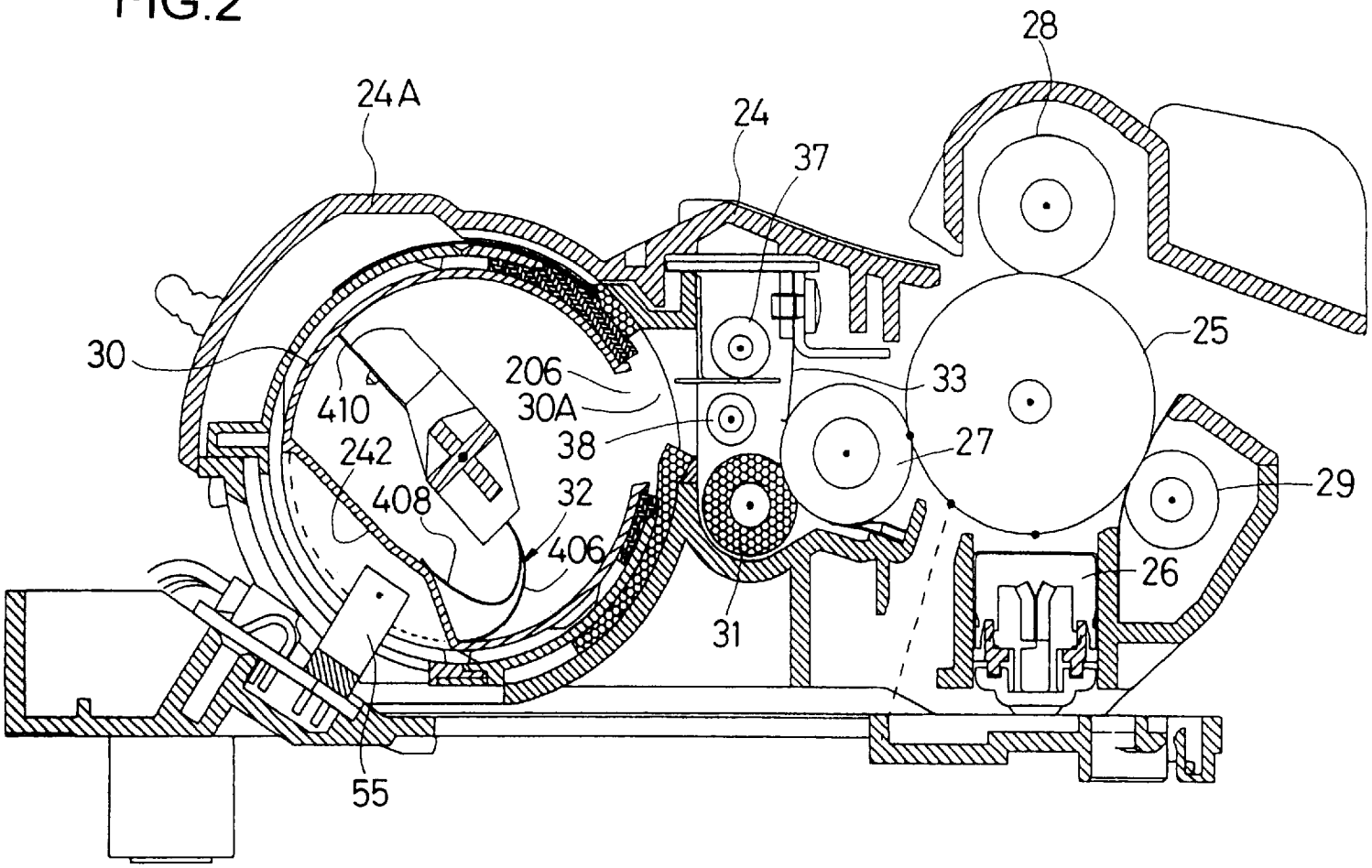
FIG. 2 is a sectional side view of a process unit in the embodiment.
Figure 3:
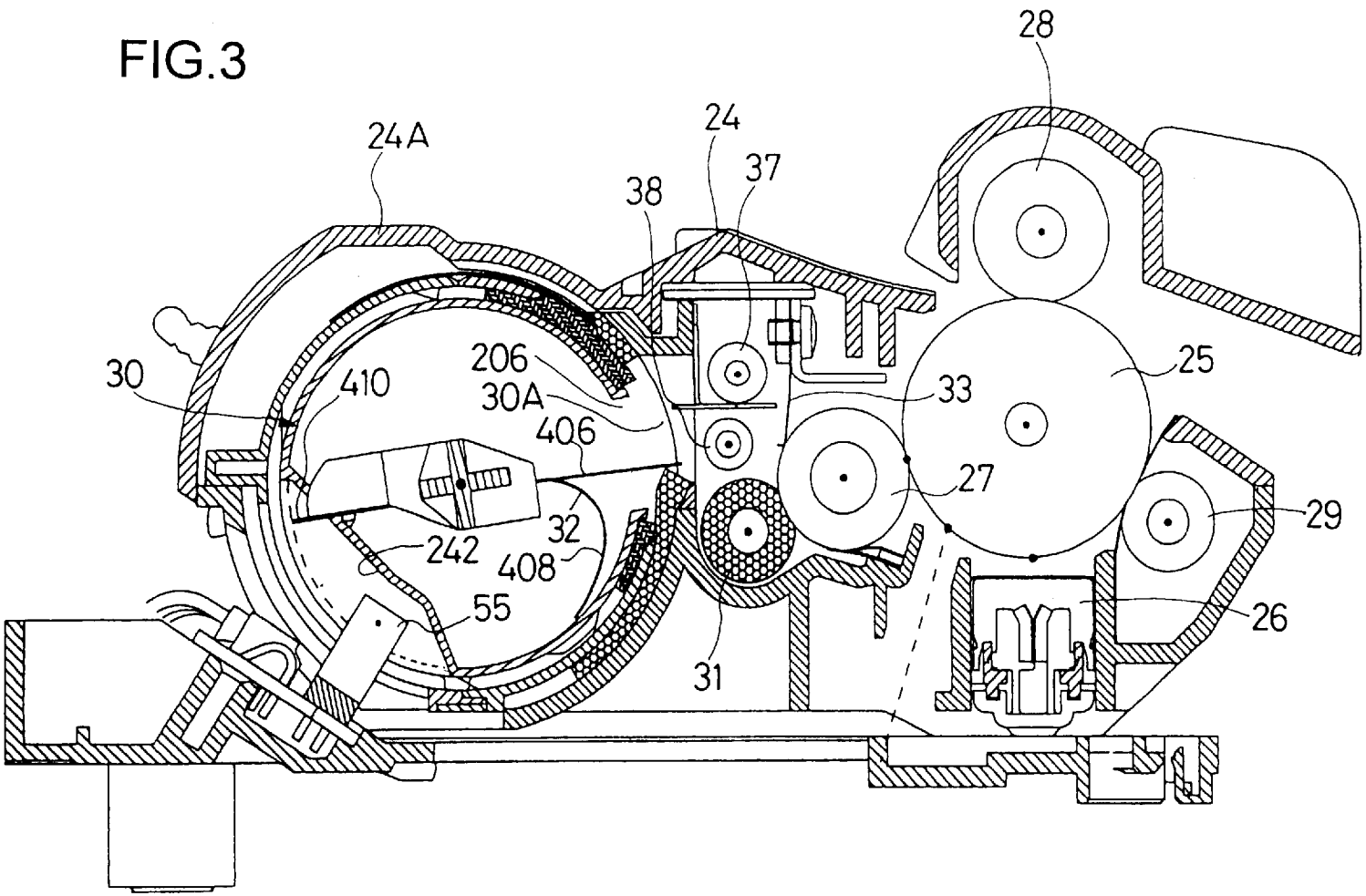
FIG. 3 is a sectional side view of the process unit of FIG. 2, which is in a toner supplying state.

First, a schematic structure of the laser printer in the present embodiment will be explained with reference to FIG. 1. FIG. 1 is a sectional side view of the laser printer. FIGS. 2 and 3 are sectional side views of a process unit of the laser printer and especially FIG. 3 shows the process unit in a toner supplying state.

In FIG. 1, the laser printer 1 is provided with a main frame 2, a first paper tray 3 and a second paper tray 4 both provided on an upper surface of a rear end side of the main frame 2, a paper feeding mechanism 5 provided in the main frame 2, a scanner unit 6, a process unit 7, a fixing unit 8, and driving units for driving the first and second paper trays 3 and 4 and the paper feeding mechanism 5 and others. Those driving units, not illustrated, are disposed at a left side in the main frame 2. On a front side upper portion of the main frame 2, provided are a top cover 10 which can be opened to expose a printing mechanism and a paper discharge tray 11. This paper discharge tray 11 can switch its position between a closed position and an open position, acting as a tray for receiving printed paper P at the open position.

It is noted that the scanner unit 6, the process unit 7, and the fixing unit 8 and others correspond to the printing mechanism. The process unit 7 is provided with a photosensitive drum 25, a charger 26, a developing roller 27, a transfer roller 28, a cleaning roller 29, and others, those members being housed in a casing 24. The process unit 7 is formed as a cartridge structure that can detachably be set in a predetermined position of the main frame 2.

The first paper tray 3 is fixedly provided on an upper side close to the rear end of the main frame 2. The second paper tray 4 is provided detachably from an upper side of the main frame 2, ahead of the first paper tray 3. The paper feeding mechanism 5 is for feeding individual paper P selectively supplied from the first and second paper trays 3 and 4 to the process unit 7. The paper feeding mechanism 5 has a pair of feed rollers 12*a* and 12*b* disposed downstream of the first paper tray 3 and a pair of resist rollers 13*a* and 13*b* disposed downstream of the second paper tray 4. The feed roller 12*a* is a driving roller and the feed roller 12*b* is a sub-roller. The resist roller 13*a* is a driving roller and the resist roller 13*b* is a sub-roller. A paper feed path 14 from the first paper tray 13 to the resist rollers 13*a* and 13*b* includes a lower side feed path 14*a* extending along a lower surface of the second paper tray 4, whereby the lower side feed path 14*a* can be opened with respect to the outside when the second paper tray 4 is detached from the main frame 2.

The paper P supplied through a pick-up roller 36 from the fist paper tray 3 is transported by the feed rollers 12*a* and 12*b* along the lower side feed path 14*a* to the resist rollers 13*a* and 13*b* which provide resistance to the paper, and then the paper P is transported to the process unit 7. The paper P supplied through another pick-up roller 36 from the second supply tray 4 is transported to the resist rollers 13*a* and 13*b* which provide resistance to the paper P, and transported to the process unit 7.

The scanner unit 6 is disposed under the process unit 7 and includes a laser emitting portion not shown, a polygon mirror 20, reflection mirrors 21 and 24, and a plurality of lenses 22, etc. A laser beam emitted from the laser emitting portion is directed, along a chain line in FIG. 1, via the polygon mirror 20, the reflection mirror 21, the lens 22, and the reflection mirror 23 toward the process cartridge 7 to expose an circumferential outer surface of the charged photosensitive drum 25 in rotation while scanning it at a high-speed to thereby form an electrostatic latent image on the surface of the photosensitive drum 25.

The process unit 7, as shown in FIG. 2, accommodates, in the casing 24, the photosensitive drum 25, the scorotron type charger 26, the developing roller 27, the transfer roller 28, the cleaning roller 29, a toner cartridge 30, and the toner supply roller 31, etc. Upon detachment of the process unit 7 from the main frame 2, the toner cartridge 30 can be detached from the process unit 7. Toner in the toner cartridge 30 is agitated and flicked by an agitator 32 to be supplied through a port 30A serving as a toner introduction port of the process unit 7 and a port 206 serving as a toner exhaust port of the toner cartridge 30 to a toner supply roller 31, and to the developing roller 27. The toner is carried on the developing roller 27, forming a toner layer with a predetermined thickness regulated by a blade 33, and is supplied to the photosensitive drum 25. It is noted that at a position close to the port 30A of the process unit 7 are disposed two auger members 37 and 38 for uniformly dispersing the toner flicked from the ports 30A and 206 within the casing 24.

A toner sensor 55 is disposed at a lower position (see FIG. 2) of the toner cartridge 30, for detecting the amount of toner existing in a toner detecting portion 240 (see FIG. 7) that is a detecting point in the toner cartridge 30, which will be mentioned later.

The developing roller 27 offers the toner to the electrostatic latent image formed on the surface of the photosensitive drum 25 to develop the electrostatic latent image, forming a visual image. The developed image is transferred onto the paper P passing between the photosensitive drum 25 and the transfer roller 28 and is fixed thereon in the fixing unit 8. Note that the toner remaining on the surface of the photosensitive drum 25 is once collected by the cleaning roller 29 and then is collected through the photosensitive drum 25 to the developing roller 27.

The fixing unit 8 for performing heat-fixing of toner on the paper P has a heat roller 34, a pressure roller 35 which is in contact under pressure with the heat roller 34, a pair of discharge rollers 15*a* and 15*b* for discharging the paper P to the outside of the main frame 2. The discharge rollers 15*a* and 15*b* are disposed downstream of the rollers 34 and 35. In the laser printer constructed as above for making an image formation by an electrophotography process, the image formation can be achieved by supply of toner to an electrostatic latent image formed on the surface of the photosensitive drum 25 to develop the image and transfer of the developed image onto the paper P.

It is noted that the feed speed (the first feed speed) at which the paper P is fed by the photosensitive drum 25 and the transfer roller 28 in the process unit 7 is set to be equal with or larger than the feed speed (the second feed speed) at which the paper P is fed through the heat roller 34, the pressure roller 35, and the discharge rollers 15*a* and 15*b* in the fixing unit 8. This is because there is a possibility that the second feed speed larger than the first feed speed causes pulling of the paper P at a nip point between the photosensitive drum 25 and the transfer roller 28, resulting in positional displacement of the image to be formed on the paper P when the toner image formed on the photosensitive drum 25 is transferred to the paper P, thus causing blur of the visual image.

Figure 4:
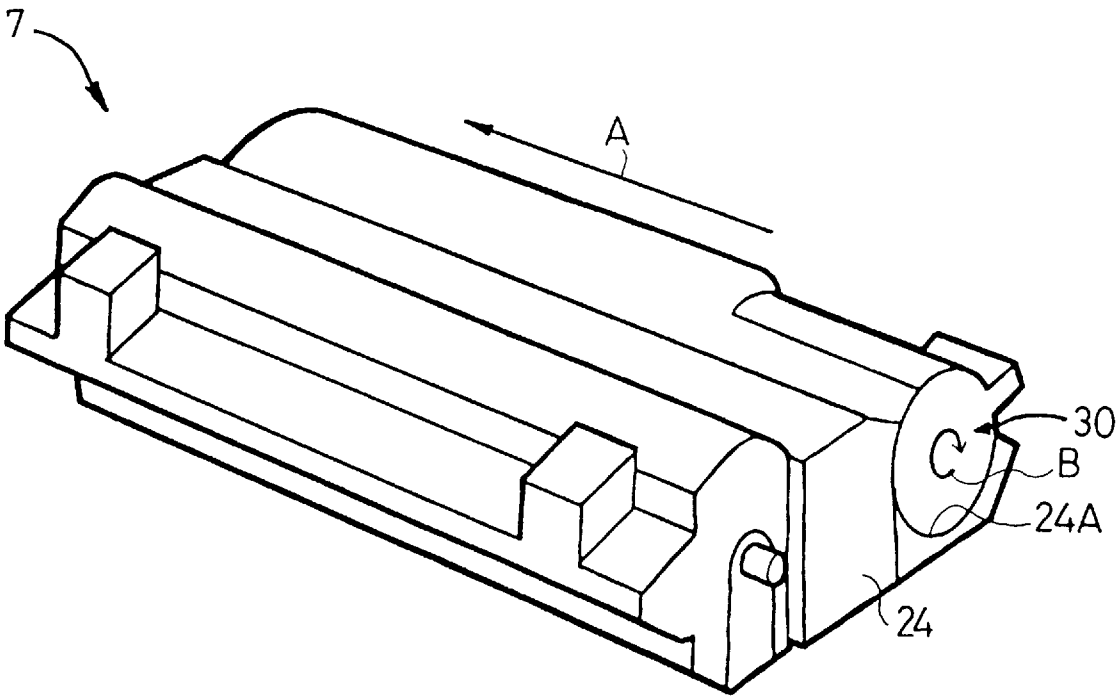
FIG. 4 is a perspective view of the process unit.
Figure 5:
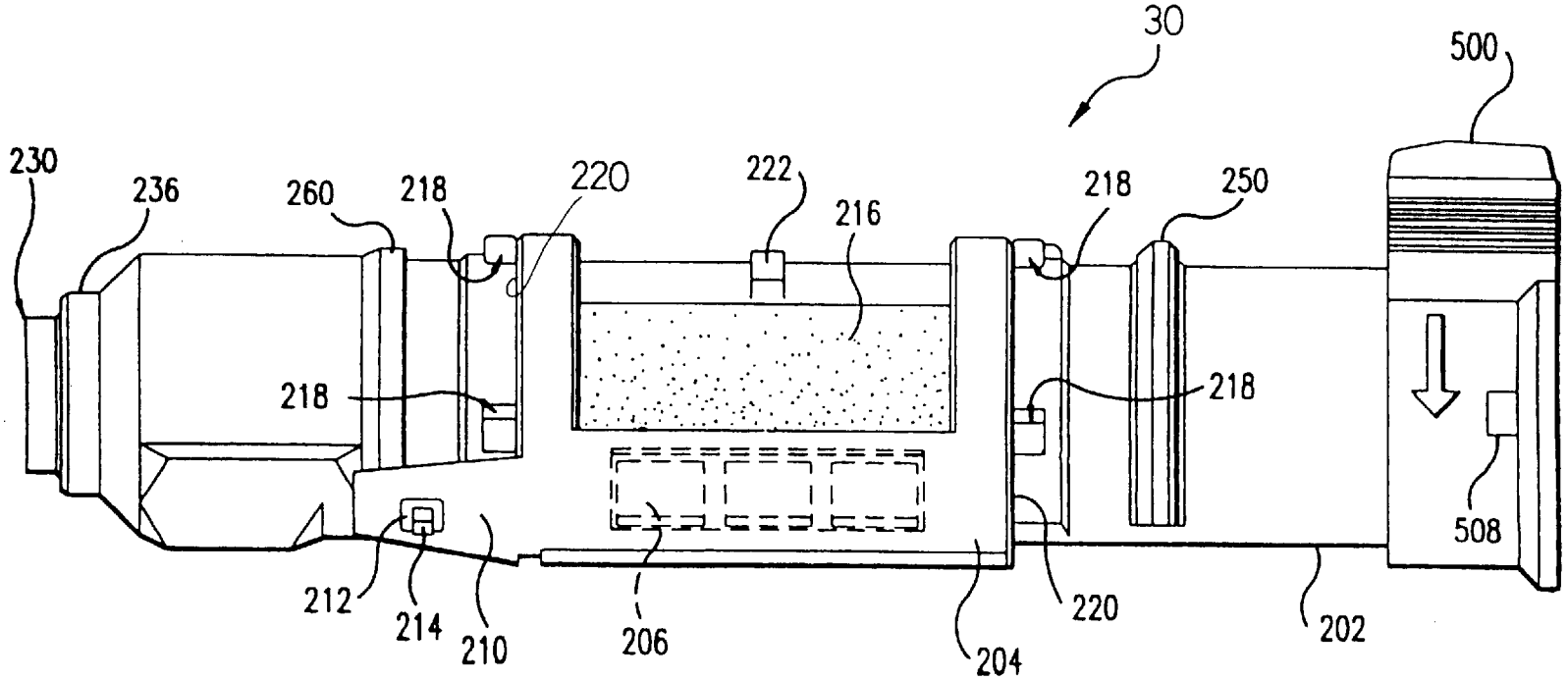
FIG. 5 is a front view of the toner cartridge.
Figure 6:
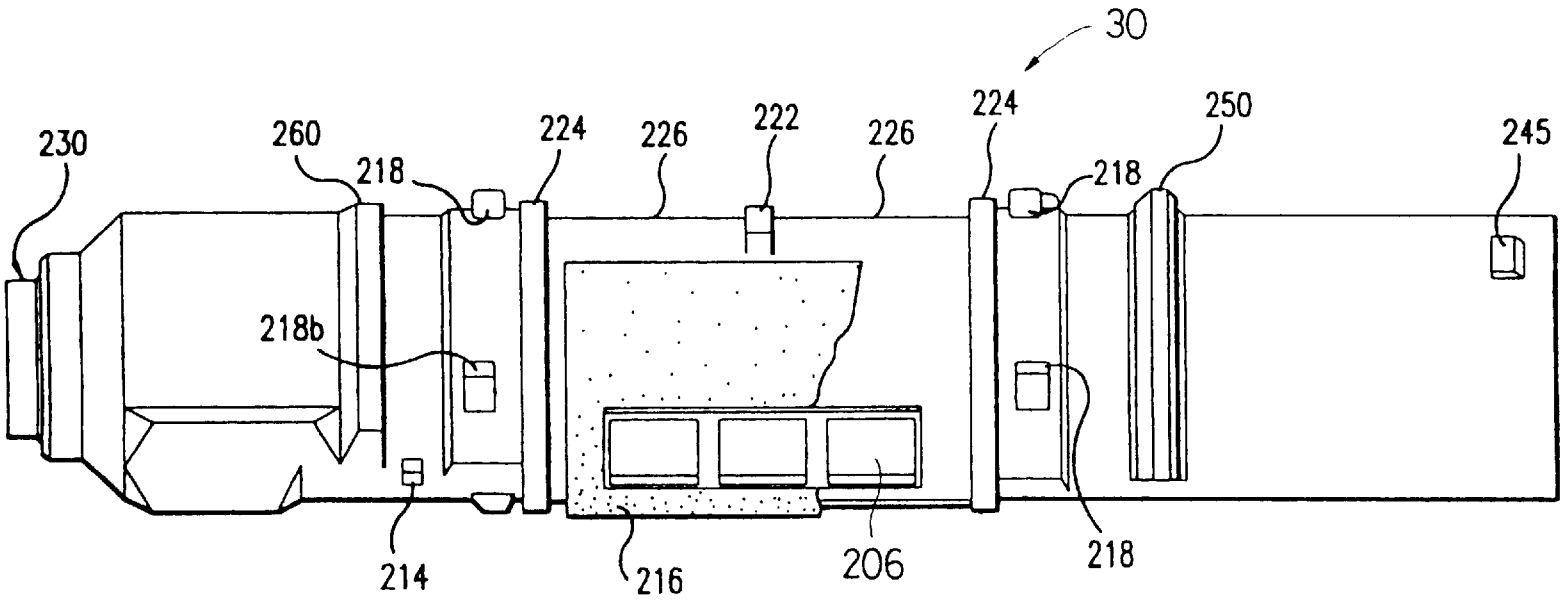
FIG. 6 is a view of the toner cartridge of FIG. 5 from which an exhaust port shielding member and a cap have been removed to facilitate understanding.
Figure 7:
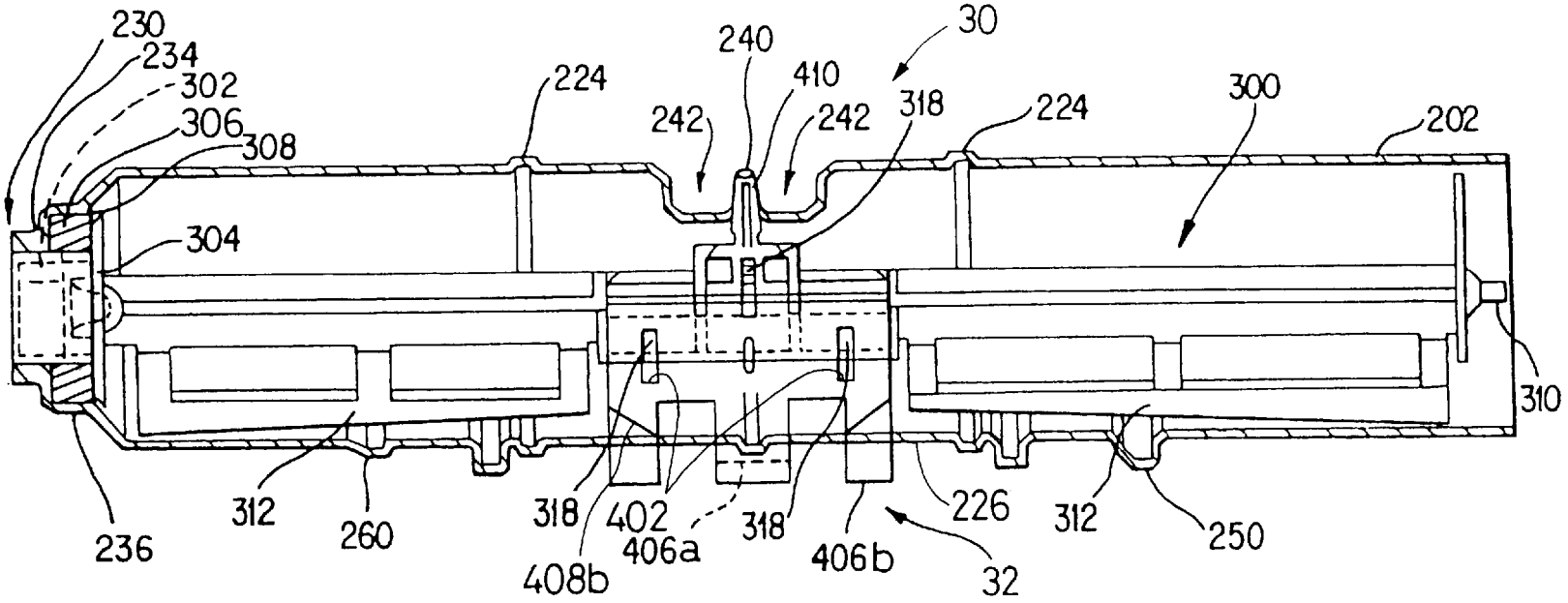
FIG. 7 is a sectional view of the toner cartridge.

Next, explanation is made on the structures of the process unit 7 and the toner cartridge 30, referring to FIG. 4 through FIG. 7. FIG. 4 is a perspective view of the process unit 7 in which the toner cartridge 30 is set. FIGS. 5 and 6 are front views of the toner cartridge 30 detached from the toner cartridge 7. Note that, in FIG. 6, an exhaust port shielding member 204 and a cap 500 are removed to facilitate understanding. FIG. 7 is a sectional view of the toner cartridge 30 to show the internal structure.

In the present embodiment, the toner cartridge 30 accommodating toner is attachable from an installing open portion 24A into the process unit 7. More specifically, upon insertion of the toner cartridge 30 into the process unit 7 in a longitudinal direction (indicated by an arrow A in FIG. 4), the toner cartridge 30 is rotated in its circumferential direction (indicated by an arrow B in FIG. 4) to be properly set in the process unit 7.

As shown in FIGS. 5 and 6, the toner cartridge 30 includes a blow-molded resin body 202, a cap 500 for closing one end port of the resin body 202, a toner exhaust port shielding member 204 disposed at a center of the resin body 202 to selectively open and close a toner exhaust port 206, a toner sealing member 216 adhered adjacent and surrounding the toner exhaust port 206, and an agitator 32 having a rotating shaft 300 provided extending in a longitudinal direction within the resin body 202. The toner exhaust port shielding member 204 can selectively open and close the toner exhaust port by moving along the circumference of the resin body 202 in the manner mentioned later. When the agitator 32 in the toner cartridge 30 is rotated in the sequential movement shown in FIGS. 2 and 3 to agitate the toner in the toner cartridge 30, the toner is supplied from the port 206 of the toner cartridge 30. The toner sealing member 216 can prevent the toner from escaping from the toner exhaust port 206 in the toner supply.

The blow-molded resin body 202 is explained below.

The blow-molded resin body 202 is made of any suitable resin which has good properties relating to flexibility and which does not react with the toner or promote adherence between the toner and inside surface of the toner cartridge 30. For resin materials of the resin body 202, for example, vinyl chloride, polypropylene, and polyethylene-terephthalate (PET) resins can be selected in view of good recyclability and cost.

This blow-molded resin body 202 is formed with a plurality of integral convex or concave portions. For instance, a projection 214 formed integrally with the blow-molded resin body 202 is engaged with a recess 212 provided in an extension 210 of the exhaust port shielding member 204 to thereby position the member 204 in a closed state. When the extension 210 is engaged with a releasing member (not shown) of the process unit 7, releasing the projection 214 from the recess 212, the projection 214 can rotate with respect to the toner body 202 to expose the toner exhaust port 206. A pair of projections 218 are formed on each lateral edge 220 of the exhaust port shielding member 204 to guide the shielding member 204 along the circumference of the resin body 202.

A plurality of guiding ribs are provided on the circumferential outer surface of the blow-molded resin body 202 as shown in FIG. 6. A central rib 222, which is an example of the guiding ribs, is provided to guide a central portion of the exhaust port shielding member 204 in the circumferential direction of the resin body 202.

A pair of lateral guiding ribs 224 are disposed just below the exhaust port shielding member 204 adjacent the projections 218. The center rib 222 and lateral ribs 224 ensure that a small space is maintained between the inner surface of the shielding member 204 and a circumferential outer surface 226 of the resin body 202 adjacent the center rib 222 and the lateral ribs 224.

The blow-molded resin body 202 is provided with a main rib 250 and a supplemental rib 260, each being positioned in an end side with respect to the pair of the projections 218, both of which are formed protruding from the circumferential surface 226 of the resin body 202 so that the height of the main rib 250 extending away from the circumferential outer surface 226 is larger than that of the supplemental rib 260 (see FIG. 7). Due to the height of the main rib 250 and the supplemental rib 260, the toner cartridge 30 can be smoothly inserted from an installing open portion 24A into the process unit 7 along the direction A in FIG. 4.

The toner detecting portion 240 is provided at a center of the blow-molded resin body 202, which has a tapered shape. More specifically, recesses 242 are formed at each side of the toner detecting portion 240 that decreases in size in cross-section toward the outside of the resin body 202, forming a taper. A light emitting portion of a toner sensor 55 is inserted in one recess 242 and a light receiving portion of the same is inserted in another one 242. With this structure, the light receiving portion of the toner sensor 55 receives the light emitted from the emitting portion (not shown) of the toner sensor 55 and passed through the toner detecting portion 240 to optically detect the toner level in the toner detecting portion 240.

Therefore the resin body 202 is made of a resin material such as, for example, polypropylene, which can be blow-molded to be semi-transparent, thus allowing an adequate amount of light to pass therethrough for toner level detection, while eliminating or absorbing any unwanted latent light which may be reflected by ambient structures.

Adhesion of toner to the toner detecting portion 240 may cause malfunction of the toner sensor 55. To avoid it, the toner detecting portion 240 is required to be cleaned just before the toner detection. In the present embodiment, a cleaning blade 410 is provided in the agitator 32 to regularly clean the toner detecting portion 240. The cleaning blade 410 having a fletchings-like shape is made from a thin film-like material having flexibility. Due to the fletchings-like shape, the cleaning blade 410 can adequately wipe the inner surface of the toner detecting portion 240.

Figures 8A, 8B, 8C, 8D:
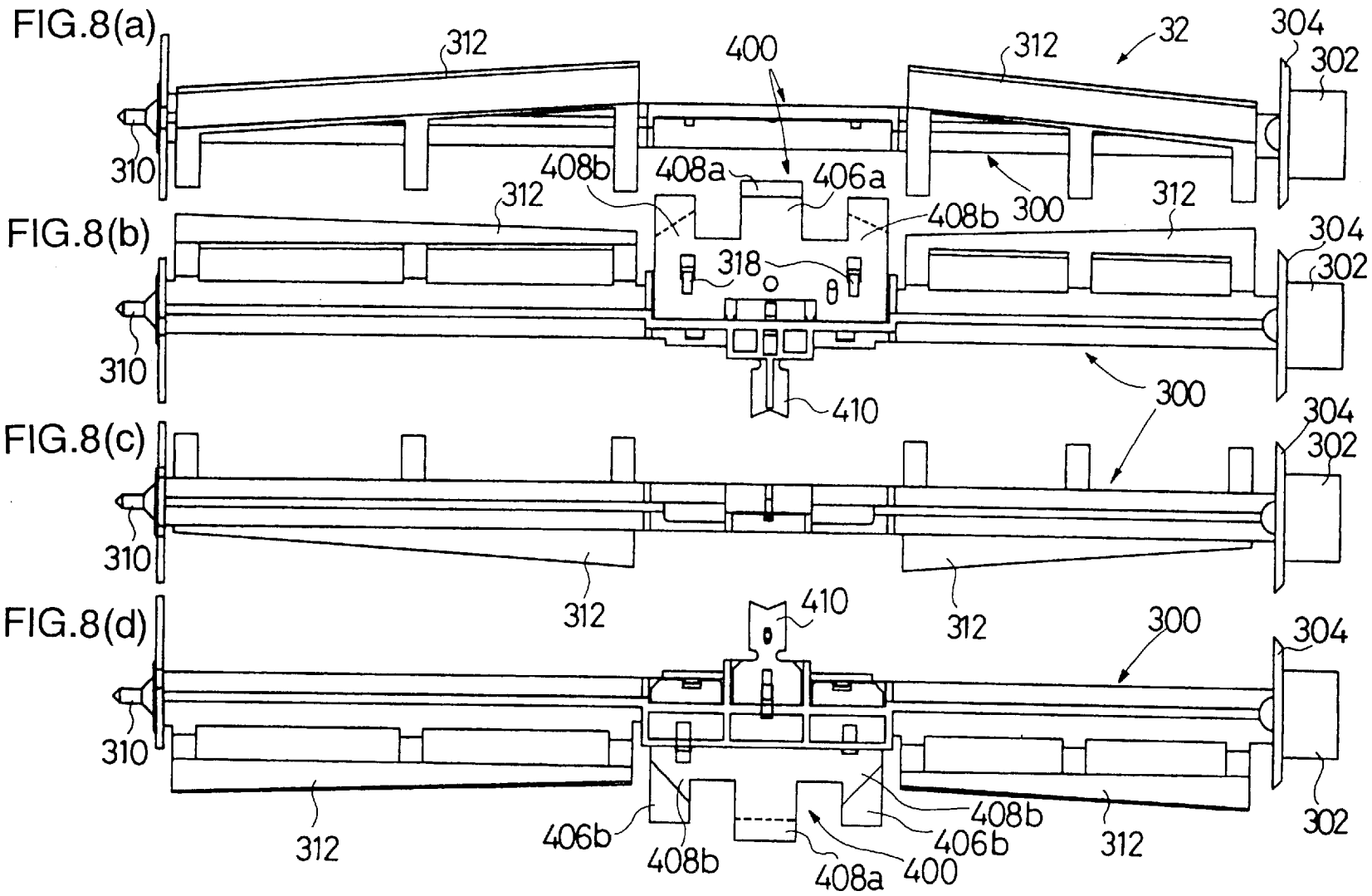
FIG. 8(*a*) is a plane view of an agitator in the present embodiment.

The agitator 32 includes a shaft 300 as shown in FIG. 8. Formed at an end of the shaft 300 is a bearing pin 310 with a flange. At the opposite end of same, a power transmitting member for rotating the agitator is provided. A central agitating blade 400 is mounted on the shaft 300 at the opposite side with respect to the cleaning blade 410. Each of a pair of lateral agitating blades 312 is provided adjacent to the central agitating blade 400.

It is noted that FIG. 8(*a*) is a plane view of the agitator 32, FIG. 8(*b*) is a front view of same, FIG. 8(*c*) is a bottom view of same, and FIG. 8(*d*) is a view showing the agitator 32 rotated downward by 180° from a position of FIG. 8(*b*).

Preferably, the lateral agitating blades 312 are formed such that edges thereof extend along the entire length thereof into close contact with the interior surface of the resin body 202 to scrape toner therefrom. Each lateral agitating blade 312 is, desirably, made of a material that can be flexibly deformed.

The central agitating blade 400 includes thin blade members 406 and 408 made from such as, for example, thin film materials. Those thin blade members 406 and 408 are secured to the shaft 300 using a plurality of clips 318 integrally molded onto the shaft 300. The clips 318 are engaged with a plurality of recesses 402 cut into the central agitating blade 400.

The central agitating blade 400 for agitating toner within the toner cartridge 30 to supply the toner through the port 206, which has at least two thin blade members having flexibility, is constructed so that the second thin blade member 408 rotates after the first thin blade member 406 (see FIGS. 2 and 3).

The agitator 32 including the thin flexible blade members 406 and 408 is capable of agitating toner by rotation of the first thin blade member 406 and preventing the toner pushed by the first member 406 from flowing backwards by the second thin blade member 408 which receives the toner flowing behind the first member 406. Especially, when toner in the toner cartridge 30 is consumed up to about one-third level with respect to a full level, there is a high possibility that the toner existing in the toner detecting portion 240 is dispersed when the first thin blade member 406 comes down from the recesses 242 (see FIG. 2), thereby allowing light of the toner sensor 55 to pass through the toner detecting portion 204. Therefore, the second thin blade member 408 prevents such the dispersion of the toner.

Figure 16A:
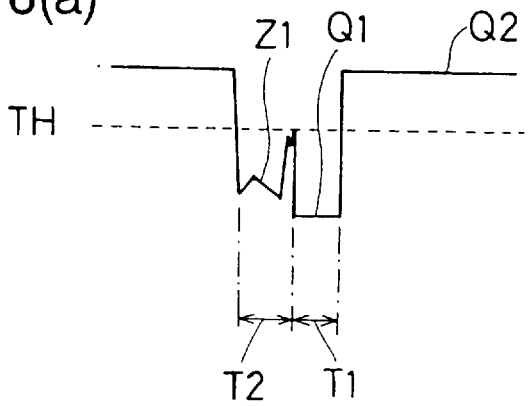
FIG. 16(*a*) is a graph of detecting an amount of residual toner in the toner cartridge using an agitator with a single blade.
Figure 16B:
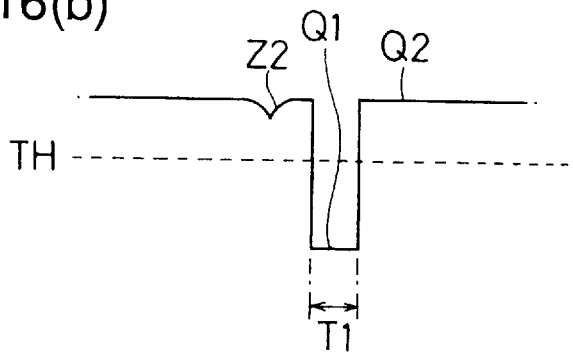
Figure 17:
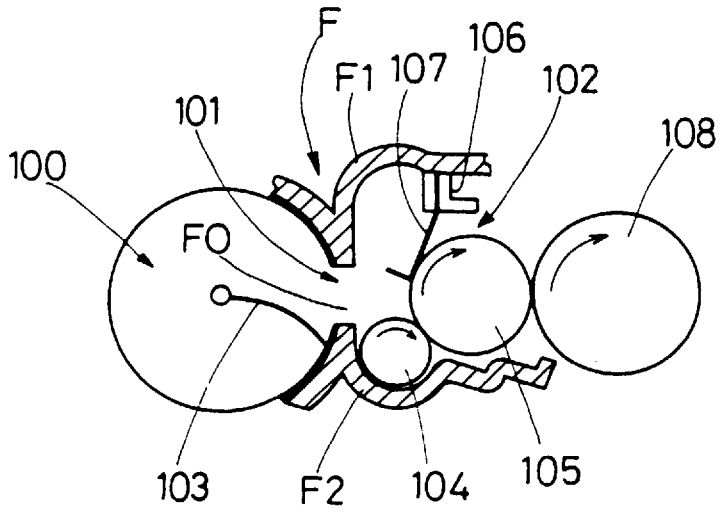
FIG.17 PRIOR ART
FIG. 17 is schematic view of a main part of a developing device in the prior art.

The above state will be explained below using a waveform diagram (see FIG. 16) based on the output signal of the toner sensor 55 to detect an amount of residual toner in the toner cartridge 30. To facilitate understanding, two different cases are adopted; FIG. 16(*a*) shows a case of an agitator having a single thin blade member and FIG. 16(*b*) shows another case of the agitator 32 having two thin blade members 406 and 408.

The toner existing in the toner detecting portion 240 to block detection light is caused to be dispersed by wiping of the cleaning blade 410 of the agitator 32, allowing the detection light to pass through the detecting portion 240. The toner sensor 55 then produces a detection signal (Q1) that is lower than a threshold voltage TH. If the amount of toner in the toner cartridge 30 is adequate, the toner immediately returns back into the toner detecting portion 240, so that a signal (Q2) higher than the threshold voltage TH is produced.

On the other hand, if the toner amount in the toner cartridge 30 is, for example, about one-third of a full amount, the toner dispersed in the toner cartridge 30 does not immediately return back into the toner detecting portion 240, which increases the time T1 required for producing a signal Q2 higher than the threshold voltage TH. By detecting the time T1 and comparing it with the time predetermined in correspondence to the toner amount, the amount of residual toner in the toner cartridge 30 can be detected.

However, in the case of the agitator having a single thin blade member, the toner to block detection light is dispersed by rotation of the blade, when the detection light of the toner sensor 55 is allowed to pass through the detecting portion 240, which may produce a low signal (Z1) in comparison with the threshold voltage TH as shown in FIG. 16(*a*). Accordingly, the time T2 is added to the time T1 required until a detection signal higher than the threshold voltage TH is produce after the wiping by the cleaning blade 410, resulting in a long time. As a result, there is a case that the toner sensor 55 may produce a false signal indicating that the toner amount is low, though it is in fact sufficient.

When the first thin blade member 406 comes down from the recesses 242 (see FIG. 2), there is a high possibility that the toner in the toner detecting portion 240 is dispersed, allowing detection light of the toner sensor 55 to pass through the detecting portion 240. In the embodiment, since the second thin blade member 408 prevents the dispersion of toner, the toner in the detecting portion 240 blocks passing of detection light of the toner sensor 55, which can produce a signal (Z2) not lower than the threshold voltage TH as shown in FIG. 16(*b*). Consequently, in the case of the agitator having the second thin blade member 408, the toner amount in the toner cartridge 30 can be accurately detected by detecting only the time T1 required for producing a detection signal higher than the threshold voltage TH after the wiping operation by the cleaning blade 410 and comparing it with the predetermined time. This makes it possible to prevent the toner sensor 55 from producing a false signal.

The agitator, of course, may have three or more thin blade members. It is also possible to provide the second thin blade member 408 so as to rotate considerably later than the first thin blade member 406.

As shown in FIG. 9, the first thin blade member 406 has a central portion 406*a* and side portions 406*b*. The second thin blade member 408 has a central portion 408*a* and side portions 408*b*. The central portion 406*a* of the first member 406 is short in length in a radial direction of the toner cartridge 30 in comparison with the central portion 408*a* of the second member 408 (see FIG. 8(*b*)). Accordingly, the long central portion 408*a* of the second member 408 can prevent the back-flow of the toner agitated by the short central portion 406*a* of the first member 406 and returned behind the central portion 406*a*.

Each length of the central portions 406*a* and 408*a* acting as a toner agitator, in the radial direction of the toner cartridge 30, is determined to be larger than the inside radius of the toner cartridge 30. Each tip end portion of the first and second thin blade members 406 and 408, having flexibility, can be deformed against the circumferential inner surface of the resin body 202 as shown in FIGS. 2 and 3 thereby to satisfactorily agitate toner within the body 202, urging the toner in a rotating direction of the agitator, to supply the toner into the developing chamber.

The flexible clearing blade 410 for wiping toner adhered in the toner detecting portion of the toner cartridge 30 is mounted on the rotating shaft 300. The thin blade members 406 and 408 of the central agitating blade 400 are also mounted on the shaft 300 at the opposite position with respect to the cleaning blade 410. When the central agitating blade 400 including the two flexible thin blade members 406 and 408 agitates toner by rotation of the first member 406, the toner tends to flow behind the first member 406. The central agitating blade 400 then prevents the back-flow of the toner by the second member 408 receiving the toner flowing backward. The flexible cleaning blade 410 wipes toner adhered in the toner detecting portion 240 of the toner cartridge 30.

The shape of the side portions 408*b* of the second thin blade member 408 may be changed to, for example, a triangle to regulate an amount of toner to be supplied through the ports 206 and 30A, whereby the dispersion of the toner within the toner cartridge 30 can be regulated. It is noted that the cleaning blade 410 in the embodiment is integrally molded with the second thin blade member 408, which can be mounted together with the first thin blade member 406 on the shaft 300 using the clips 318. The cleaning blade 410 may be, of course, made separately from the second thin blade member 408. The shape of the first thin blade member 406 may also be changed to regulate the toner supply amount.

An end port 230 of the blow-molded resin body 202 has steps which become gradually smaller in diameter toward the end of the resin body 202 as shown in FIG. 6, serving as a bearing portion for the shaft 300. At an end of the shaft 300 is provided an engagement recess member 302 formed cylindrically and a flange 304 integrally formed with the engagement member 302 as shown in FIGS. 7 and 8, to which a driving shaft not shown is rotatably inserted. The rotation of the driving shaft inserted in the engagement recess member 302 in response to the driving power of motors and the like causes the integral rotation of the engagement member 302 and the flange 304 and thus the shaft 300 with respect to the resin body 202, thereby to rotate the agitator 32 in the resin body 202 of the toner cartridge 30. Thus, the engagement member 302 and the flange 304 serve as a power transmitting member for causing rotation of the agitator 32.

To transmit the driving power to the engagement recess member 302 and the flange 304 to rotate the agitator 32 in the toner cartridge 30, the engagement recess member 302 of the shaft 300 is inserted in the end port 230 of the toner cartridge 30 as shown in FIG. 7. At that time, it is necessary to prevent leakage of toner from the toner cartridge 30. Especially, the toner cartridge 30 is manufactured by a blow-molding technique, which is low in cost, but the blow-molded resin body 202 does not have always a uniform inside surface, which may produce gaps between the inside surface of the resin body 202 and the engagement member 302, causing the leakage of toner through the gaps.

Figure 11A:
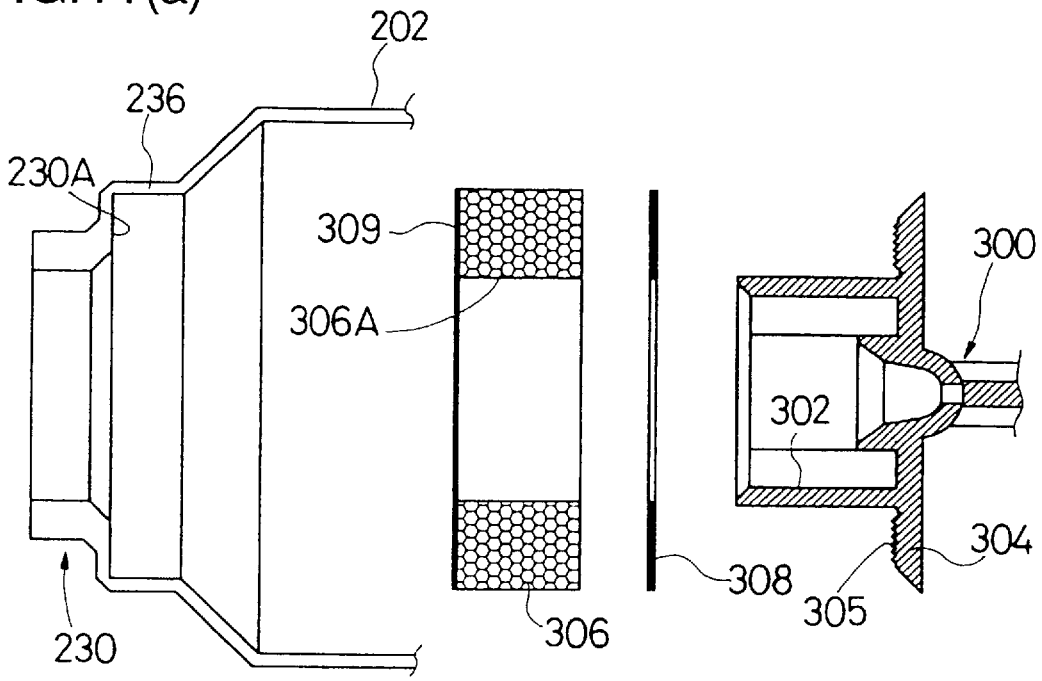
FIG. 11(*a*) is an exploded sectional view of the engagement portion and the flange to be assembled in an end port of the toner cartridge in the present embodiment.
Figure 11B:
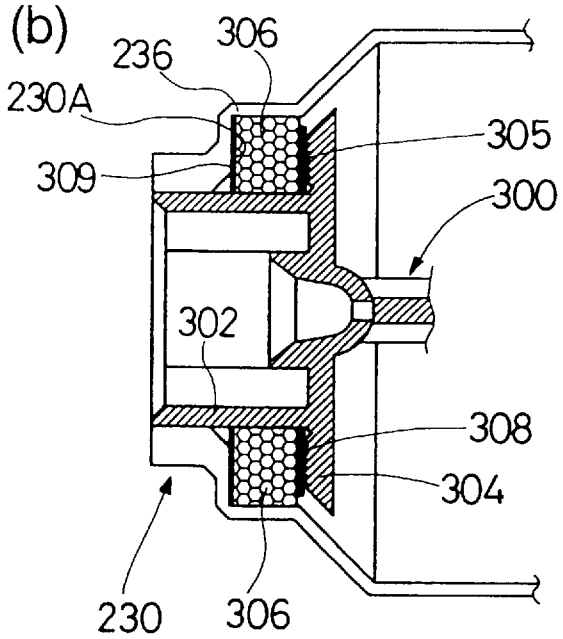

To avoid the leakage of toner through gaps produced between the resin body 202 and the engagement member 302, a soft sealing member 306 which is made of a sponge material such as urethane foam and provided with a through hole is attached in close contact to the engagement member 302 and the flange 304 such that the engagement member 302 is inserted in the through hole of the sealing member 306 as shown in FIGS. 11(*a*) and (*b*). In order to prevent rotation of the sealing member 306 with respect to the resin body 202, preferably, a washer member 308 is disposed between the sealing member 306 and the engagement member 302 and the flange 304. The washer member 308 is a thin film having abrasion resistance, made of, for example, teflon felt, polyethylene terephthalate, etc.

Figure 10A:
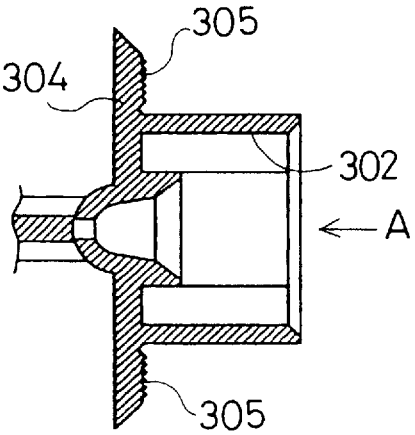
FIG. 10(*a*) is a sectional view of an engagement member and a flange in the embodiment.
Figure 10B:
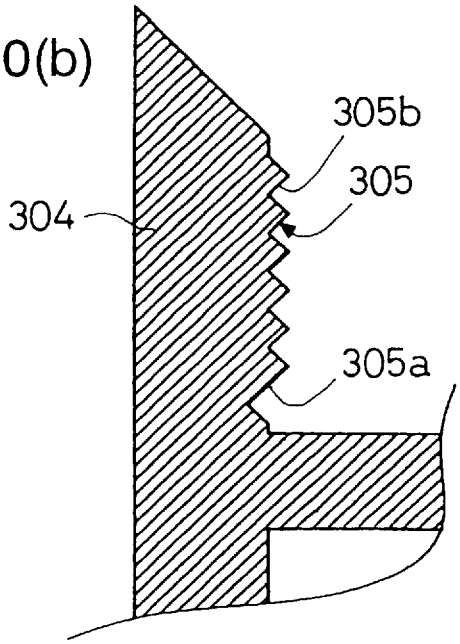
Figure 10C:
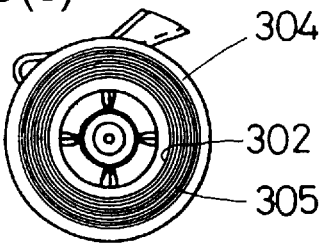

On at least one of contact surfaces of the washer member 308 and the flange 304, namely, the contact surface of the flange 304 in the embodiment, a grooved portion 305 is provided as shown in FIGS. 10(*a*) and (*b*).

FIG. 10(*a*) is a cross sectional view of the engagement member 302 and the flange 304. FIG. 10(*b*) is an enlarged cross sectional partial view of the FIG. 10(*a*). FIG. 10(*c*) is a side view of the FIG. 10(*a*).

The grooved portion 305 formed on the flange 304 can decrease the contact area between the contact surface of the washer member 308 and that of the flange 304, reducing contact resistance therebetween. Accordingly, rotation of the sealing member 306 can be prevented by the existence of the washer member 308 even when the engagement member 302 and the flange 304 are rotated and as a result thereof the leakage of toner can be prevented.

In general, toner entering between the contact surfaces of the washer member 308 and the flange 304 may cause the increase of friction resistance therebetween. When toner enters in the grooved portion 305, however, the toner does not substantially exist between the contact surfaces of the washer member 308 and the flange 304, which can prevent the increase of friction resistance therebetween.

The grooved portion 305 in the present embodiment is constituted of, as shown in FIG. 10(*c*), a plurality of concentric circular grooves formed on the flange 304, surrounding the cylindrical engagement member 302. Therefore, only apex portions formed between adjacent grooves of the grooved portion 305 come into contact with the contact surface of the washer member 308, so that the contact area of the contact surfaces between the flange 304 and the washer member 308 is reduced, thereby decreasing the contact resistance. Consequently, the washer member 308 can prevent the rotation of the sealing member 306 even when the engagement member 302 and the flange 304 are rotated.

The grooved portion 305 includes a central groove 305*a* positioned at the most center side in the flange 304. The central groove 305*a* is provided, as shown in FIG. 10(*b*), so as to be deeper than other grooves 305*b*, so that toner easily enters in the central groove 305*a* and does not substantially exist between the contact surfaces of the washer member 308 and the flange 304. This makes it possible to prevent the increase in friction resistance between the washer member 308 and the flange 304. As a result thereof, the sealing member 306 can be prevented from rotating even when the engagement member 302 and the flange 304 are driven to rotate.

It is desirable to apply a grease material on each contact surface of the engagement member 302, the flange 304, and the sealing member 306. Concretely, it is sufficient to apply the grease material on an circumferential inside surface 306A of the through hole of the sealing member 306 (see FIG. 11(*a*)), which reduces the sliding resistance between the contact surfaces of the engagement member 302 and the flange 304 and the contact surface of the sealing member 306. The rotation of the sealing member 306 can thus be prevented even when the engagement member 302 and the flange 304 are rotated. It is noted that the grease material should be selected from the type of materials from which oil is hard to ooze. Even when some oil ooze from the grease material, the oil will collect in the grooved portion 305 formed on the flange 304, not sticking to toner in the toner cartridge 30.

Note that there is a case that the washer member 308 is not required to be disposed between the contact surfaces of the engagement member 302 and the flange 304 and the contact surface of the sealing member 306. In this case, the engagement member 302 and the flange 304 on which the sealing member 306 is directly attached are inserted in the end port 230 of the toner cartridge 30. It is accordingly preferable to provide a grooved portion 305 to at least one of the contact surfaces of the sealing member 306, the engagement member 302, and the flange 304 and especially to the contact surface of the flange 304. Such the grooved portion 305 causes a decrease of the contact area between the contact surfaces of the engagement member 302 and the flange 304 and the contact surface of the sealing member 306, reducing contact resistance.

Furthermore, a member 309 having a sucking property is desirably attached to the contact surface of the sealing member 306 which comes into contact with an inner surface 230A (see FIG. 11) of the toner cartridge 30 when the engagement recess member 302 and the flange 304 are inserted through the sealing member 306 into the end port 230 of the toner cartridge 30. The sucker member 309 is adhered to one surface of the sealing member 306 made of a sponge foam material. The flange 304 serving as a pressing member presses the sealing member 306 through the washer member 308 from the opposite surface of the sealing member 306, which is a surface on which the sucker member 309 is not adhered, toward the inner surface 230A of the end port 230, thus making the sucker member 309 come into firm contact with the inner surface 230A.

The sucker member 309 is preferably made of, for example, a soft resin film with a good contact property, having a thickness of about 100 $\mu$m. In the embodiment, a SG sheet made by BRIDGESTRONE Corp. is used.

This sucker member 309 does not stick to any portion even when it comes into contact with the inner surface of the resin body 202 at the time of insertion of the engagement member 302 and the flange 304 through the sealing member 306 into the end port 230 of the resin body 202, and, with a lapse of time, it can be in close contact with the inner surface 230A of the end port 230. Consequently, the sucker member 309 can prevent the sealing member 306 from rotating with respect to the engagement member 302 and the flange 304 during their rotation, making it possible to prevent the leakage of toner from gaps between the inner surface of the resin body 202 and the engagement member 302.

Disposed on an end of the toner cartridge 30 is a cap 500 having a size capable of sealably closing an end of the blow-molded resin body 202. A protrusion 245 (see FIG. 6) is provided on the circumferential outer surface of the resin body 202, which can be engaged with a recess 508. Once the projection 245 engages with the recess 508, the cap 500 is positively locked against rotation with respect to the blow-molded resin body 202 (see FIG. 5). The cap 500 includes an integrally blow-molded knob 506 extending radially away from a peripheral wall of the cap 500. With manipulation of the knob 506, the toner cartridge 30 can be properly set in the toner cartridge 7.

Figure 12A:
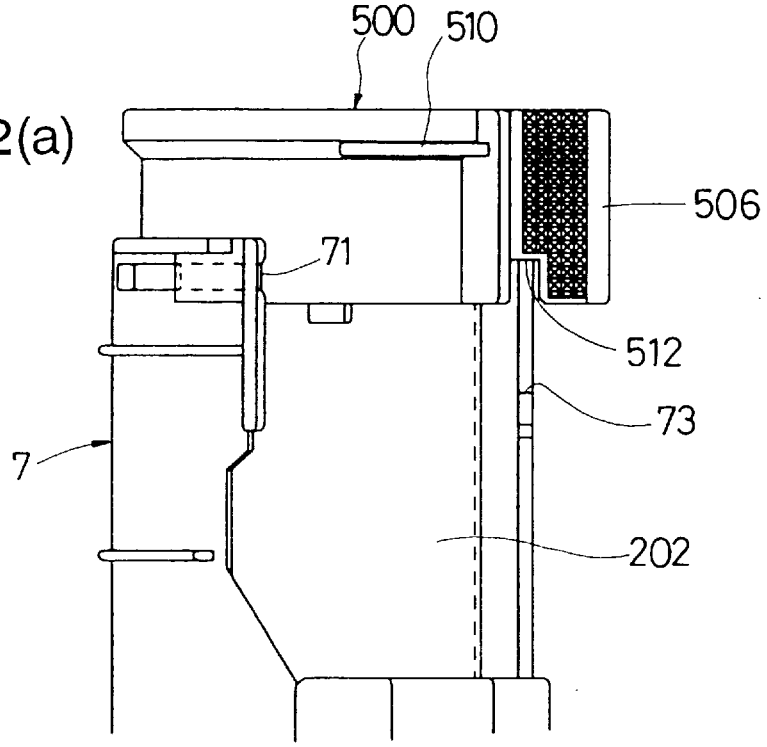
FIG. 12(*a*) and (*b*) are explanatory views showing a sequential operation to insert the toner cartridge into the process unit.
Figure 12B:
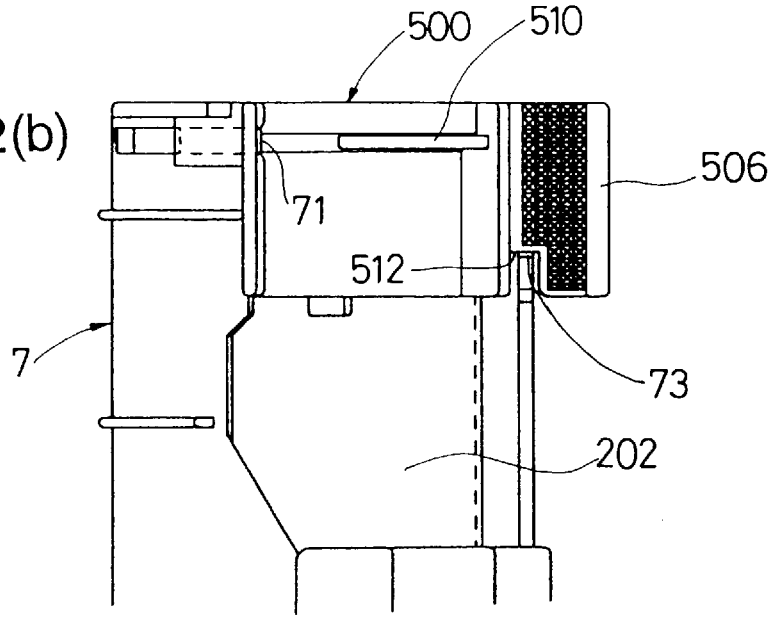
Figure 13A:
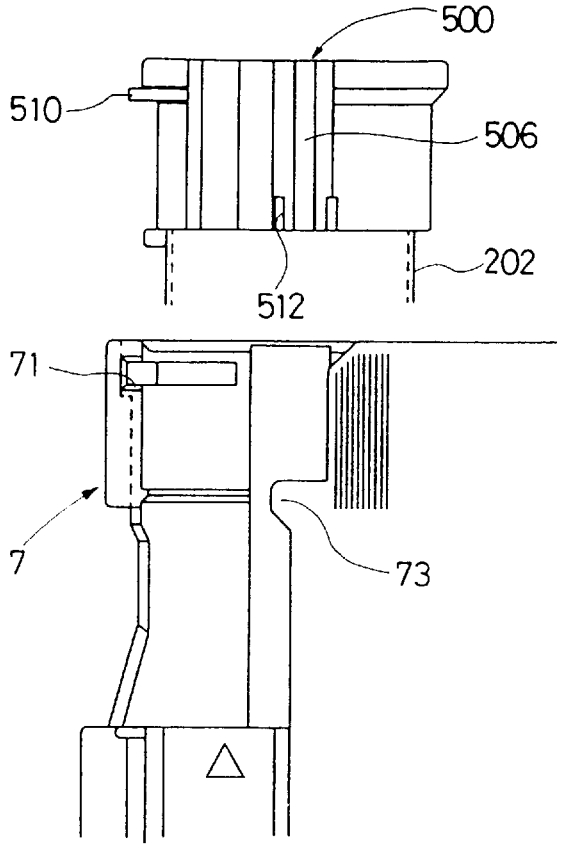
FIG. 13(*a*) and (*b*) are side views of FIG. 12(*a*) and (*b*)
Figure 13B:
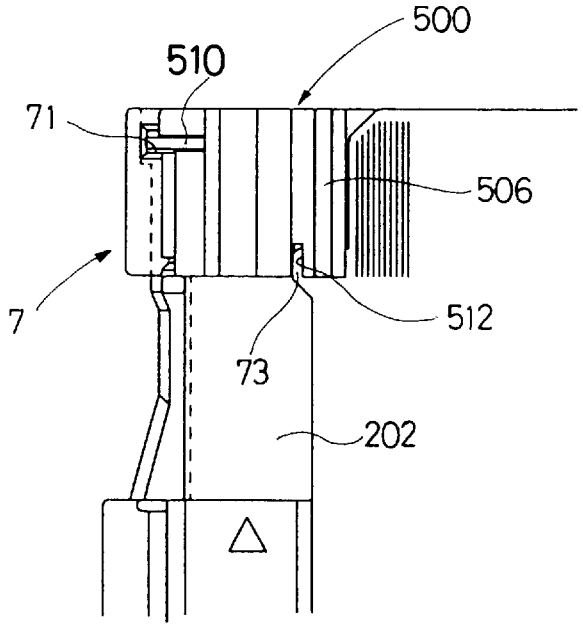

The cap 500 is provided, as shown in FIGS. 12 and 13, a protrusion 510 acting as an engagement portion for indicating the type of toner cartridge, etc. The process unit 7 is provided with a recess 71 acting as a receiving portion for engaging with only a predetermined protrusion 510. Additionally, a recess 512 as another engagement portion is provided on the outer surface of the toner cartridge 30 and a protrusion 73 as a receiving engagement portion is provided on the process unit 7. More specifically, the protrusion 510 is formed extending in a circumferential direction of the cap 500. The recess 71 is formed into a key groove at an entrance portion of the process unit 7. The recess 512 is formed at a lower side of the knob 506. The protrusion 73 is formed protruding at the entrance portion of the process unit 7, below the recess 71.

The toner cartridge 30 constructed as above is inserted in the process unit 7 as shown in FIG. 12(*a*) and FIG. 13(*a*) so that the recess 512 engages with the protrusion 73 as shown in FIG. 12(*b*) and FIG. 13(*b*). Once the toner cartridge 30 is in this position, the cap 500 with the knob 506 is rotated in a direction causing the protrusion 510 to engage with the recess 71 of the process unit 7. When the toner cartridge 30 detachably inserted in a corresponding process unit 7 is rotated, the indicating engagement portions 510 and 512 of the toner cartridge 30 can engage with the corresponding receiving engagement portions 71 and 73 of the process unit 70 respectively.

Figure 14:
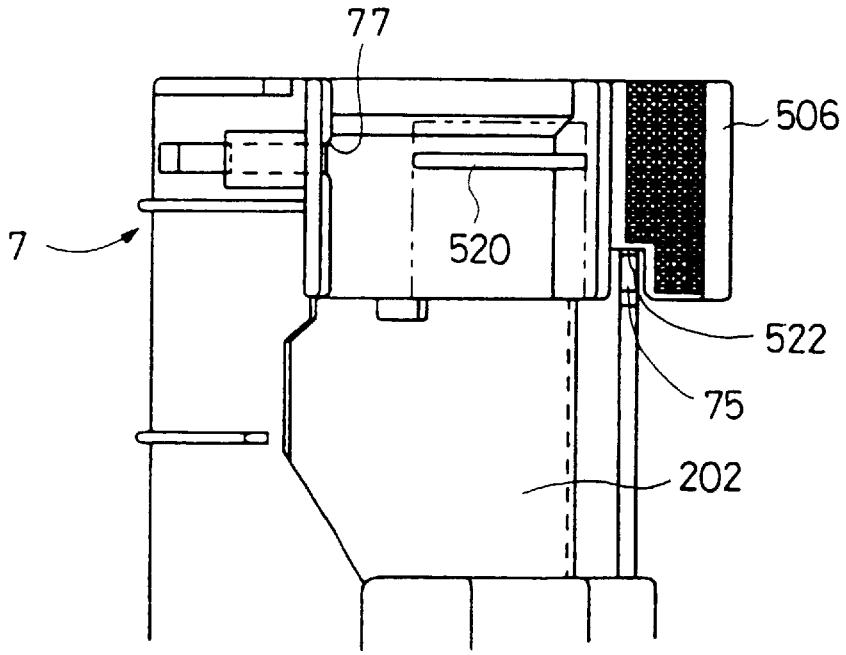
FIG. 14 is an explanatory view showing the toner cartridge inserted in the process unit according to a different aspect from FIG. 12(*a*) and (*b*)
Figure 15A:
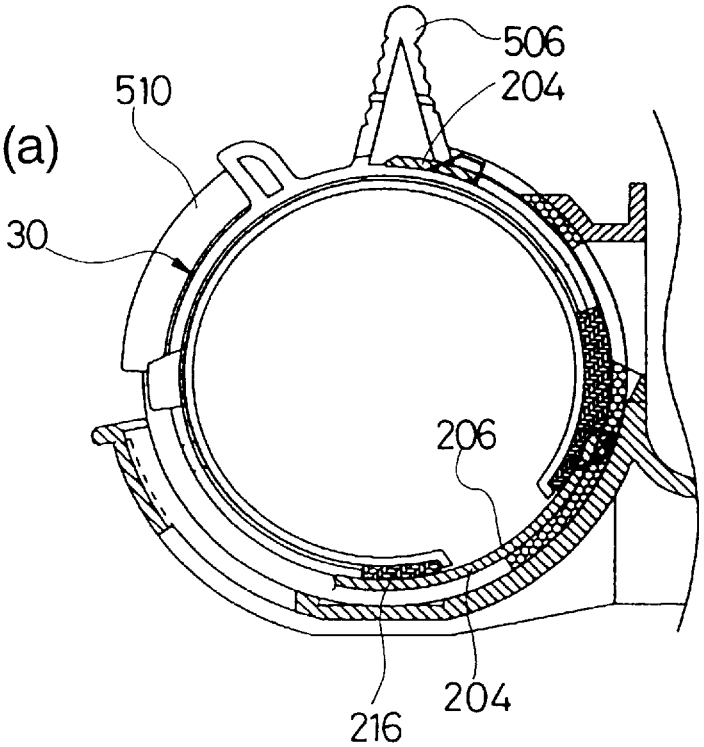
FIG. 15(*a*) and (*b*) are sectional views showing a sequential operation to insert the toner cartridge into the process unit.
Figure 15B:
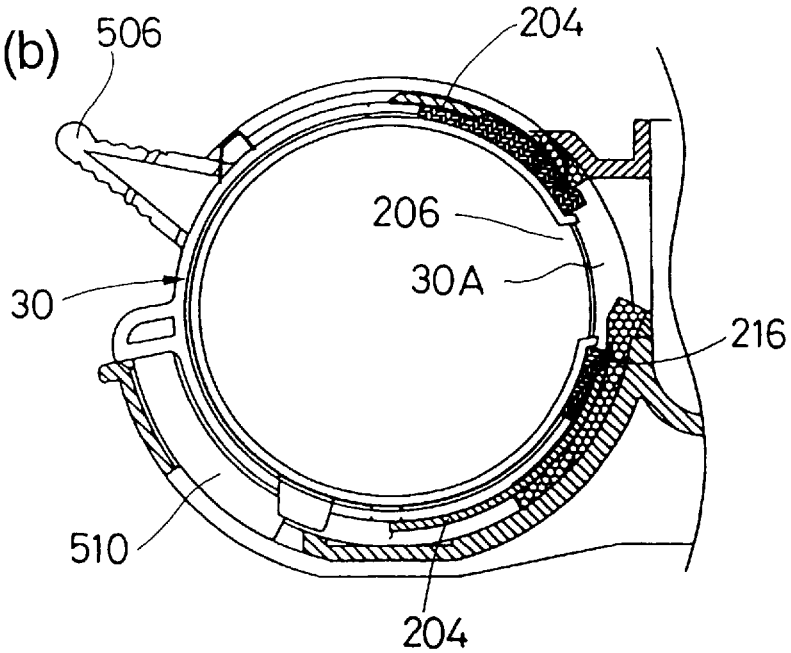

Another aspect of the cap 500 is shown in FIG. 14. The cap 500 includes an engagement protrusion 520 for indicating the type of toner cartridge 30 different from that in the above example. The process unit 7 is provided with a recess 77 serving as an receiving portion which can engage with only the engagement protrusion 520. Furthermore, a recess 522 as an engagement portion for indicating the type of toner cartridge is provided on the outer surface of the toner cartridge 30 and a protrusion 75 as an engagement portion is provided on the process unit 7. More specifically, the protrusion 520 is formed protruding in the circumferential direction of the cap 500. The recess 77 is formed into a key groove at an entrance portion of the process unit 7. The recess 522 is formed at a lower side of the cap 500. The protrusion 75 is formed protruding at the entrance portion of the process unit 7.

The toner cartridge 30 constructed as above is inserted in the cartridge 7 so that the protrusion 75 engages with the recess 522, which is shown in FIG. 14. Once the toner cartridge 30 is in this position shown in FIG. 14, the cap 500 is rotated in a direction causing the protrusion 520 to engage with the recess 77 of the cartridge 7. In this way, when the toner cartridge 30 is detachably inserted and rotated in the proper process unit 7, the indicating engagement portions 520 and 522 of the toner cartridge 30 can engage with the receiving engagement portions 77 and 75 respectively of the corresponding cartridge 7.

Accordingly, only proper installation of the toner cartridge 30 shown in FIG. 12 into the corresponding process unit 7 shown in FIG. 12 can cause engagement between the engagement portions 510 and 512 of the toner cartridge 30 and the engagement portions 71 and 73 of the cartridge 7. Only proper installation of the toner cartridge 30 shown in FIG. 14, similarly, into the corresponding process unit 7 shown in FIG. 14 can cause engagement between the engagement portions 520 and 522 and the engagement portions 77 and 75 of the cartridge 7.

If the toner cartridge 30 shown in FIG. 12 is installed in the process unit 7 shown in FIG. 14 which is not adapted to the toner cartridge 30, the engagement portions 510 and 512 of the toner cartridge 30 can not engage with the receiving engagement portions 75 and 77 of the cartridge 7. Thus, false installation of the toner cartridge 30 can be prevented. The same applies to false installation of the toner cartridge 30 shown in FIG. 14 into the cartridge 7 shown in FIG. 12. When the toner cartridge 30 is properly installed in the process unit 7 adapted for this toner cartridge 30, the engagement portions 510, 512, 520, and 522 can be properly positioned with respect to respective corresponding receiving engagement portions 71, 73, 75, and 77. Those engagement portions may be formed reversely into protrusions or recesses.

As shown in FIG. 4, insertion of the toner cartridge 30 along direction A in FIG. 4 into the corresponding process unit 7 causes the extension 210 of the exhaust port shielding member 204 to engage a lock releasing projection not shown provided on the cartridge 7 to bend the extension 210 away from the outside surface of the blow-molded resin body 202, thus releasing engagement between the projection 214 of the resin body 202 and the recess 212 of the shielding member 204. In this state, upon manipulation of the knob 506 of the cap 500, the toner cartridge 30 can be rotated with respect to the exhaust port shielding member 204 to open the toner exhaust port 206.

As mentioned above, toner supply from the toner cartridge 30 to the process unit 7 can be performed upon rotation of the toner cartridge 30 after insertion into the process unit 7 to open the toner exhaust port, when toner does not leak from the process unit 7 to the outside thereof. Accordingly, toner can surely be supplied through the exhaust port from the toner cartridge 30 to the process unit 7. This can prevents the toner leaking from the process unit 7 from contaminating components inside the image forming apparatus.

The present invention may be embodied in other specific forms without departing from the spirit or essential characteristics thereof. For instance, the image forming apparatus may be applied to coping machines, facsimile machines, printing machines, etc. Furthermore, the invention can be applied to a case of an assembly of the toner cartridge 30 and the process unit 7 to be manufactured and sold as a set or another case of separate components of the toner cartridge 30 and the process unit 7 to be manufactured and sold individually. In addition, the toner cartridge may be formed integrally with the process unit so as not to be detachable therefrom, or the toner cartridge may be provided on the process unit so as to be detachable therefrom as mentioned in the above embodiment.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner cartridge for use in a developing device for an image forming apparatus for performing image formation by an electrophotography process, the toner cartridge comprising:

a cartridge body for accommodating toner therein, which is provided with a supply port through which the toner is supplied to a developing portion and an end port at an end thereof;

an agitating member disposed rotatably in the cartridge body, for agitating the toner by rotation in the cartridge body and for supplying the toner through the supply port to the developing portion;

a power transmitting member provided at an end of the agitating member and inserted in the end port of the cartridge body, for transmitting a driving power from an outside member to the agitating member to agitate the agitating member;

a soft sealing member disposed between an inner wall of the end port of the cartridge body and the power transmitting member; and a grooved portion provided on at least one of contact surfaces of the soft sealing member and the power transmitting member, where the both members come into contact with each other.

2. A toner cartridge according to claim 1, further comprising a washer member disposed between the power transmitting member and the soft sealing member.

3. A toner cartridge according to claim 2, wherein said power transmitting member comprises a cylindrical portion to be inserted into the end port and a flange portion integrally formed with the cylindrical portion, and said grooved portion is formed on the flange portion which comes into contact with the washer member.

4. A toner cartridge according to claim 3, wherein the grooved portion has a plurality of grooves formed concentric-circularly with respect to the cylindrical portion, surrounding it.

5. A toner cartridge according to claim 4, wherein a central groove positioned in the most center side among the plurality of grooves surrounding the cylindrical portion is formed so as to be deeper than other grooves positioned outside the central groove.

6. A toner cartridge according to claim 1, wherein the soft sealing member is formed of a sponge material.

7. A toner cartridge according to claim 6, wherein the sponge material is formed of urethane foam.

8. A toner cartridge according to claim 2, wherein the washer member is formed of a film having abrasion resistance.

9. A toner cartridge according to claim 8, wherein the abrasion resisting film comprises a teflon film or a polyethylene terephthalate film.

10. A toner cartridge according to claim 3, wherein the soft sealing member has a through hole through which the cylindrical portion of the power transmitting member is inserted, and a grease material is applied to an inner surface of the through hole.

11. A toner cartridge according to claim 2, wherein a sucker member having a sucking effect with respect to an inner wall of the end port of the cartridge body is disposed on a plane of the soft sealing member opposite to another plane touching the washer member.

12. A toner cartridge according to claim 11, wherein the sucker member is formed of a soft resin film having a high contact property with respect to the inner wall of the end port.

13. A toner cartridge according to claim 12, wherein the soft resin film has a thickness of about 100 $\mu$m.

14. A developing device for an image forming apparatus for performing image formation by an electrophotography process, the developing device comprising:

a cartridge body for accommodating toner therein, which is provided with a supply port through which the toner is supplied to a developing portion and an end port at an end thereof;

an agitating member disposed rotatably in the cartridge body, for agitating the toner by rotation in the cartridge body and for supplying the toner through the supply port to the developing portion;

a power transmitting member provided at an end of the agitating member and inserted in the end port of the cartridge body, for transmitting a driving power from an outside member to the agitating member to agitate the agitating member;

a soft sealing member disposed between an inner wall of the end port of the cartridge body and the power transmitting member; and a grooved portion provided on at least one of contact surfaces of the washer member and the power transmitting member, where the both members come into contact with each other.

15. A developing device according to claim 14, further comprising a washer member disposed between the power transmitting member and the soft sealing member.

16. A developing device according to claim 15, wherein the power transmitting member comprises a cylindrical portion to be inserted into the end port and a flange portion integrally formed with the cylindrical portion, and the grooved portion is formed on the flange portion which comes into contact with the washer member.

17. A toner cartridge for use in a developing device for an image forming apparatus for performing image formation by an electrophotography process, the toner cartridge comprising:

a cartridge body for accommodating toner therein, which is provided with a supply port through which the toner is supplied to a developing portion and an end port at an end thereof;

an agitating member disposed rotatably in the cartridge body, for agitating the toner by rotation in the cartridge body and for supplying the toner through the supply port to the developing portion;

a power transmitting member provided at an end of the agitating member and inserted in the end port of the cartridge body, for transmitting a driving power from an outside member to the agitating member to agitate the agitating member;

a soft sealing member disposed between an inner wall of the end port of the cartridge body and the power transmitting member; and a sucker member having a sucking effect with respect to an inner wall of the end port of the cartridge body, which is disposed on a plane of the soft sealing member which comes into contact with the inner wall of the end port.

18. A toner cartridge according to claim 17, wherein the sucker member is formed of a soft resin film having a high contact property with respect to the inner wall of the end port.

19. A toner cartridge according to claim 17, wherein the cartridge body is made by a blow-molding process.

20. A developing device for an image forming apparatus for performing image formation by an electrophotography process, the developing device comprising:

a cartridge body for accommodating toner therein, which is provided with a supply port through which the toner is supplied to a developing portion and an end port at an end thereof;

an agitating member disposed rotatably in the cartridge body, for agitating the toner by rotation in the cartridge body and for supplying the toner through the supply port to the developing portion;

a power transmitting member provided at an end of the agitating member and inserted in the end port of the cartridge body, for transmitting a driving power from an outside member to the agitating member to agitate the agitating member;

a soft sealing member disposed between an inner wall of the end port of the cartridge body and the power transmitting member; and a sucker member having a sucking effect with respect to an inner wall of the end port of the cartridge body, which is disposed on a plane of the soft sealing member which comes into contact with the inner wall of the end port.

* * * * *